United States Patent [19]

Zimmerman

[11] Patent Number: 4,848,012

[45] Date of Patent: Jul. 18, 1989

[54] MULTI-PURPOSE EARTHWORKING MACHINE

[76] Inventor: Harold M. Zimmerman, Rte. 1, Wabash Rd., Ephrata, Pa. 17522

[21] Appl. No.: 78,252

[22] Filed: Jul. 27, 1987

[51] Int. Cl.[4] ..... E02F 3/76

[52] U.S. Cl. ..... 37/117.5; 172/784; 37/DIG. 3; 414/912

[58] Field of Search ..... 180/209, 215; 280/638, 280/43.16, 86, 763.1, 764.1, 765.1, 766.1; 37/117.5, DIG. 3, DIG. 12, 103; 172/780, 784, 785, 786, 787, 789, 169, 195, 199, 200; 414/685, 697, 912

[56] References Cited

U.S. PATENT DOCUMENTS

| | | | |
|---|---|---|---|
| 1,706,257 | 3/1929 | Ronning | 37/DIG. 3 X |
| 3,403,802 | 10/1968 | Lundell | 37/117.5 X |
| 3,704,754 | 12/1972 | Layton | 37/117.5 X |
| 3,776,318 | 12/1973 | Layton | 37/DIG. 3 X |
| 3,822,756 | 7/1974 | Martin | 37/DIG. 3 X |
| 3,976,146 | 8/1976 | Desourdy | 280/638 X |
| 3,994,083 | 11/1976 | Cunningham | 280/638 X |
| 4,058,915 | 11/1977 | Hake | 37/117.5 |
| 4,088,236 | 5/1978 | Moore | 37/117.5 X |
| 4,189,854 | 2/1980 | Haynes | 37/117.5 |
| 4,194,584 | 3/1980 | Kress et al. | 280/638 X |
| 4,222,186 | 9/1980 | Molby | 37/117.5 X |
| 4,255,884 | 3/1981 | Williams | 37/117.5 |
| 4,360,980 | 11/1982 | Jarvis | 37/117.5 |
| 4,418,713 | 12/1983 | Schlecht | 280/766.1 X |
| 4,463,507 | 8/1984 | Gaub | 37/117.5 |
| 4,464,852 | 8/1984 | Rice | 37/117.5 |
| 4,550,512 | 11/1985 | Felster | 37/117.5 |

*Primary Examiner*—Eugene H. Eickholt

[57] ABSTRACT multi-operational earthworking machine is disclosed wherein the frame includes a telescopible front wheel assembly to permit a selective varying of the length of the wheel base. A carriage, housing an operator's station, is rotatably mounted on the frame for rotation about a generally vertical axis and carries a backhoe assembly pivotally mounted thereto for working the ground beyond the frame of the machine. A pusher type scraper assembly is also provided beneath the frame between the front and rear wheel assemblies. The scraper assembly is provided with a pair of stabilizer pads engageable with the scraper blade to stabilize the machine during operation of the backhoe assembly.

16 Claims, 5 Drawing Sheets

Fig. 5
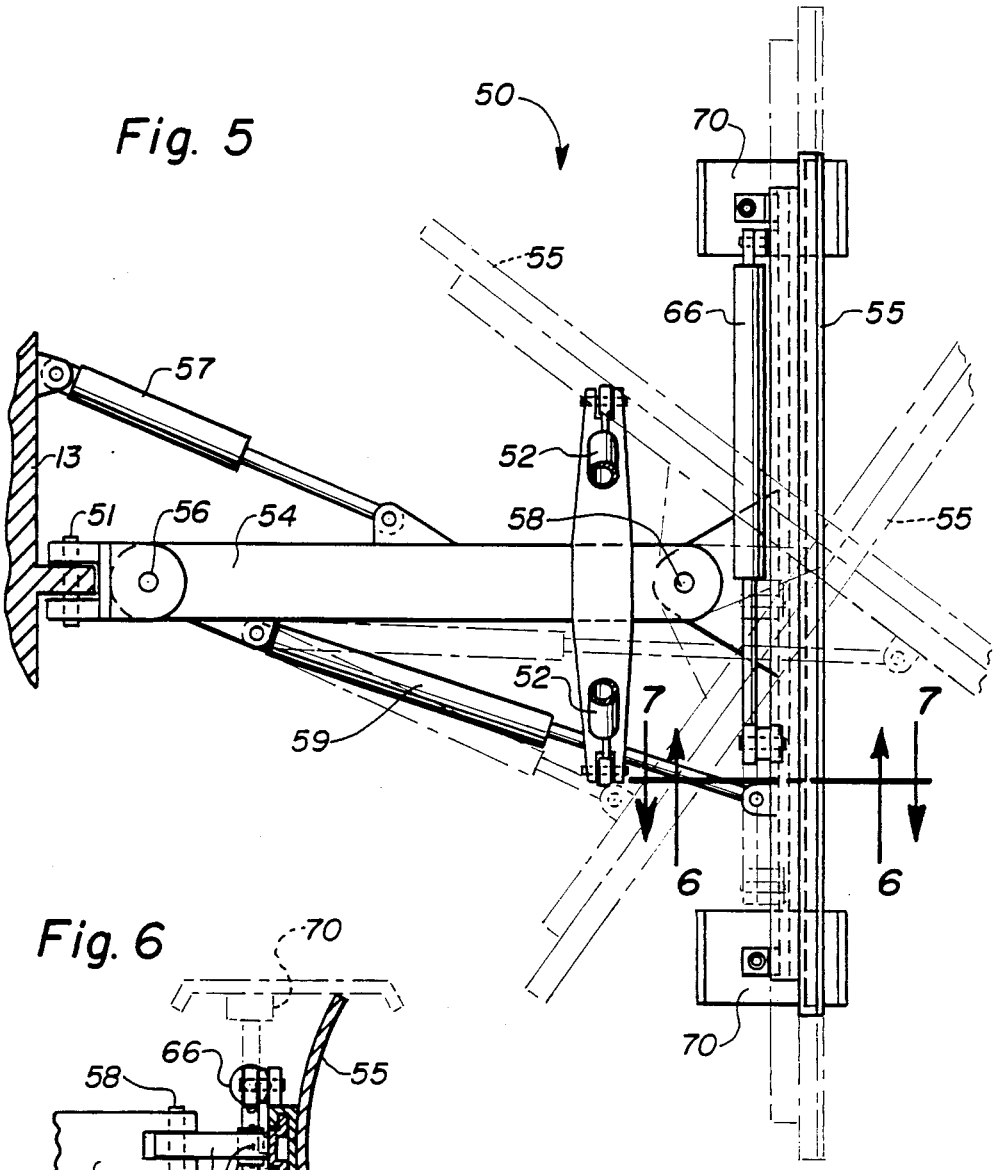
Fig. 6
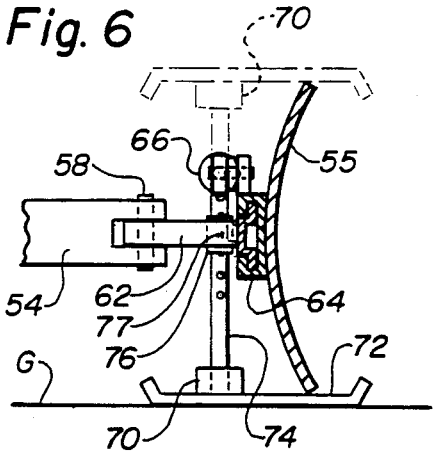
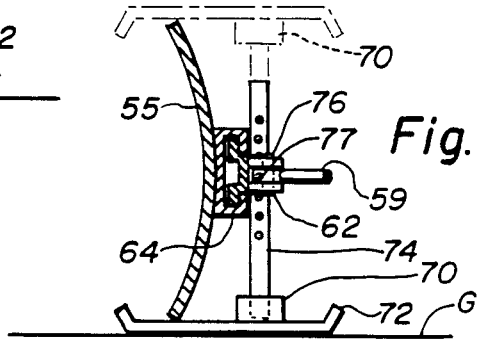
Fig. 7

MULTI-PURPOSE EARTHWORKING MACHINE

BACKGROUND OF THE INVENTION

The present invention relates generally to earthworking machines and, more particularly, to a multi-purpose earthworking machine capable of providing digging, loading and grading functions.

Typically, graders are provided with a long wheel base and a scraper blade that is supported from the front of the machine and thus pulled across the ground to perform a grading function. Digging units such as backhoes are normally provided with a smaller wheel base than graders and an articulated digging attachment, such as a backhoe boom and attached bucket, pivotally mounted on the machine to perform a digging or loading function. Digging and grading machines have not been considered compatible uses for a multi-function earthworking machine primarily because of the different wheel base requirements. A machine that would combine both digging and grading functions would be advantageous because of the versatility of earthworking operations that could be accomplished therewith.

SUMMARY OF THE INVENTION

It is an object of this invention to overcome the aforementioned disadvantages of the prior art by providing a multi-purpose earthworking machine that combines both digging and grading functions.

It is another object of this invention to provide a telescopic front wheel assembly for an earthworking machine to permit a selective varying of the wheel base to correspond to the digging and grading functions.

It is a feature of this invention that the wheel base of the earthworking machine can be selectively lengthened to correspond to the grading functions.

It is an advantage of this invention that a backhoe machine can be utilized as a grader without sacrificing the need for a longer wheel base.

It is still another object of this invention that the grader blade of the earthworking machine is supported from the rear of the machine.

It is another feature of this invention that the grader blade is pushed across the ground to affect a grading operation.

It is another advantage of this invention that the orientation of the grader blade can be controlled hydraulically from the operator's station.

It is yet another object of this invention that the grader blade is provided with stabilizing pads engageable with the blade to affect a stabilization of the earthworking machine while operating as a backhoe unit.

It is still another feature of this invention that the operator's station is housed within a carriage rotatably mounted on the frame for rotation about a generally vertical axis of rotation.

It is yet another advantage of this invention that the operator will have the operation of the backhoe occurring immediately in front of the operator's station irrespective of the orientation of the backhoe unit with respect to the frame.

It is a further advantage of this invention that hydraulic cylinders control the side-to-side movement of the scraper blade, the vertical height of the scraper blade, the angular position of the scraper blade with respect to its support arm, and the transverse movement of the scraper blade relative to the support arm.

It is yet another feature of this invention that the carriage supporting the operator's station is rotatably mounted on the frame for rotation about a 360° arc.

It is a further object of this invention to provide a multi-purpose earthworking machine which is durable in construction, inexpensive of manufacture, carefree of maintenance, facile in assemblage, and simple and effective in use.

These and other objects, features and advantages are accomplished according to the instant invention by providing a multi-operational earthworking machine wherein the frame includes a telescopible front wheel assembly to permit a selective varying of the length of the wheel base. A carriage, housing an operator's station, is rotatably mounted on the frame for rotation about a generally vertical axis and carries a backhoe assembly pivotally mounted thereto for working the ground beyond the frame of the machine. A pusher type scraper assembly is also provided beneath the frame between the front and rear wheel assemblies. The scraper assembly is provided with a pair of stabilizer pads engageable with the scraper blade to stabilize the machine during operation of the backhoe assembly.

BRIEF DESCRIPTION OF THE DRAWINGS

The advantages of this invention will become apparent upon consideration of the following detailed disclosure of the invention, especially when taken in conjunction with the accompanying drawings wherein:

FIG. 5 is a partial cross-sectional view taken along lines 5—5 of FIG. 1 to better show the scraper assembly, the tilting movement of the scraper blade and the transverse movement of the scraper blade relative to the support arm being respectively shown in phantom;

FIG. 6 is a cross-sectional detail view taken along lines 6—6 of FIG. 5 to show the mounting of the scraper blade to the support arm, the alternate positioning of the stabilizer pad being shown in phantom;

FIG. 7 is a cross-sectional detail view taken along lines 7—7 of FIG. 5 to better show the mounting of the scraper blade to the support arm;

DETAILED DESCRIPTION OF THE PREFERRED EMBODIMENT

Figure 1:
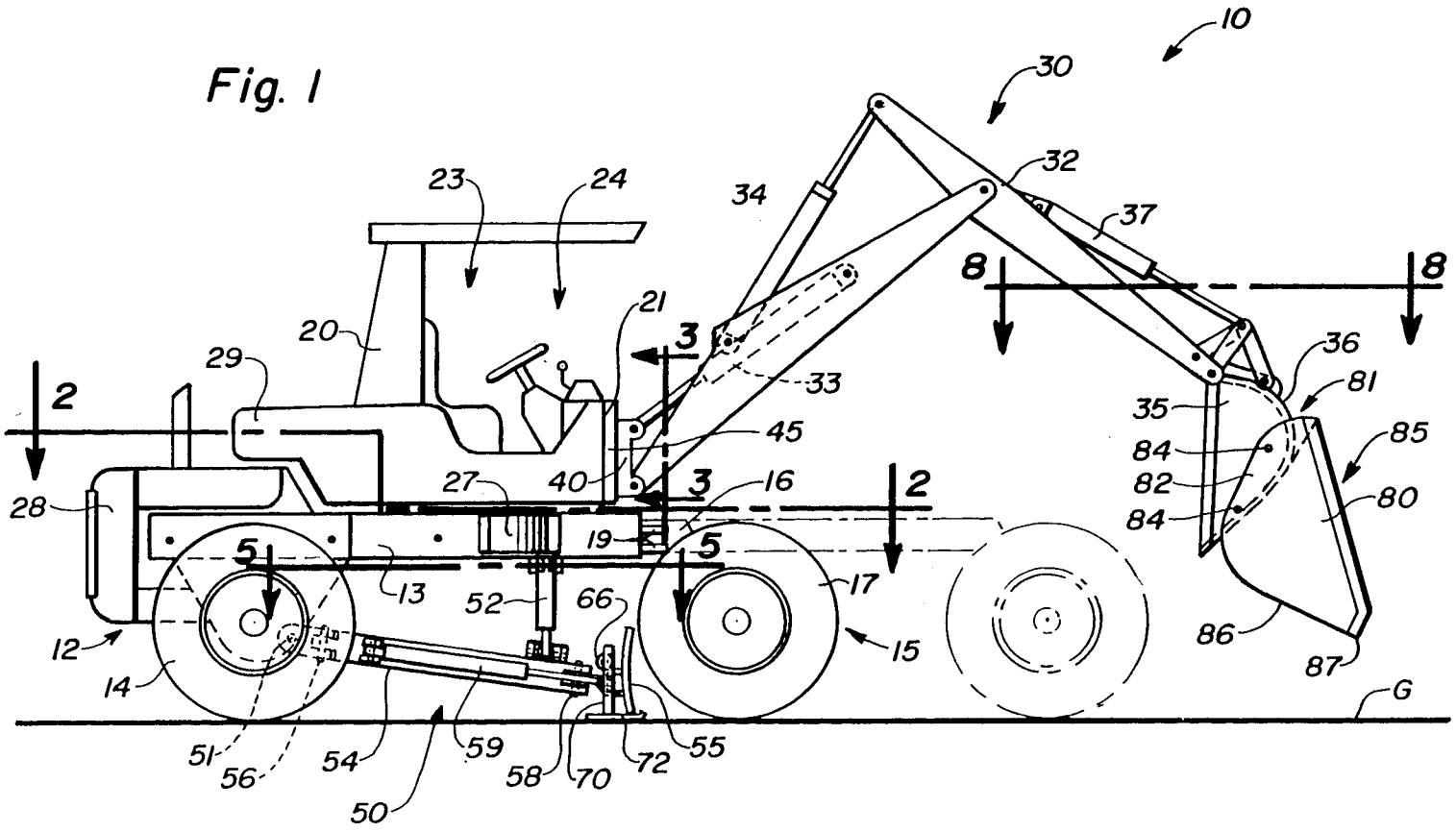
FIG. 1 is a side elevational view of an earthworking machine incorporating the principles of the instant invention, the telescopic movement of the front wheel assembly being shown in phantom.
Figure 2:
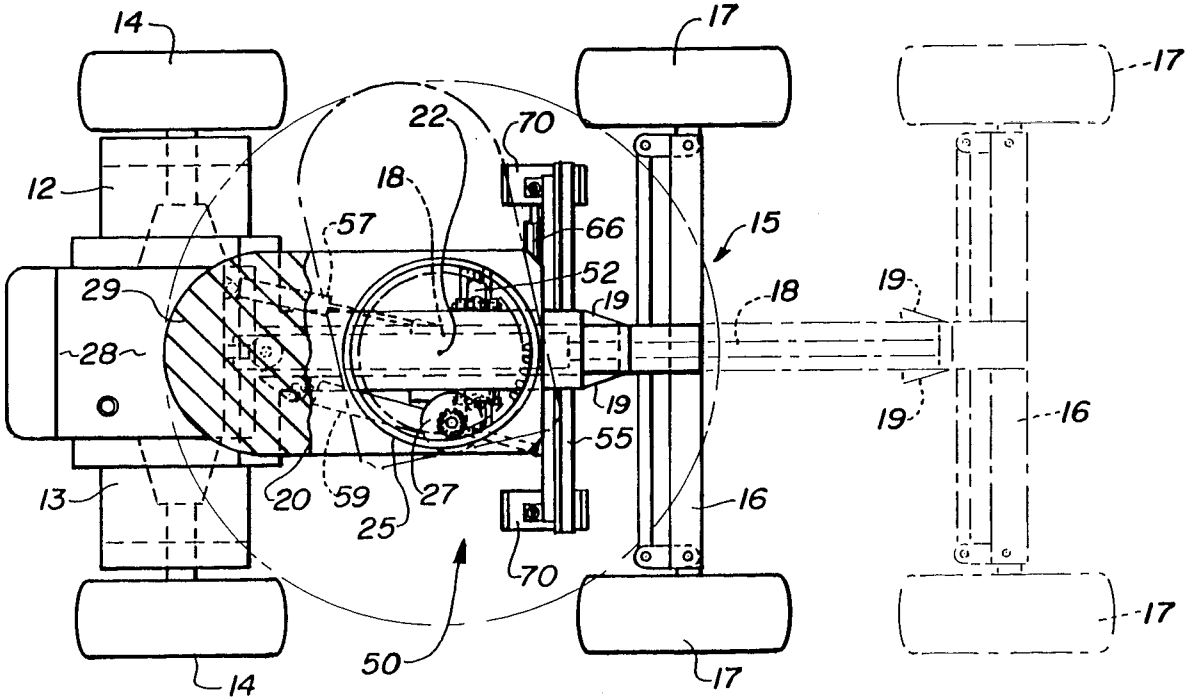
FIG. 2 is a cross-sectional view of the earthworking machine taken along lines 2—2 of FIG. 1, the rotational movement of the carriage being shown in phantom as well as the telescopic movement of the front wheel assembly.

Referring now to the drawings and, more particularly, to FIGS. 1 and 2, a front elevational view and a cross-sectional view of the multi-purpose earthworking machine incorporating the principles of the instant invention can best be seen. The earthworking machine 10 is provided with a mobile frame 12 which includes a rear subframe 13 rotatably mounting a pair of rear ground engaging wheels 14 and a front wheel assembly 15 which is provided with a pair of steerable front ground engaging wheels 17. The front wheel assembly 15 includes a front subframe 16 telescopically received within the rear subframe 13 and movable in a fore-and-aft direction by means of a hydraulic cylinder 18 positioned internally of the subframes 13,16 to affect the telescopic movement therebetween. Although the drawings depict a single telescopically related subframe member positioned along the centerline of the machine 10, it should be realized that a pair of transversely spaced telescopically related subframe members could be alternatively provided. Limits to the telescopic movement of the front subframe 16 can be hydraulically provided in conjunction with the hydraulic cylinder 18 or mechanically such as by an internal ring or the wing tabs 19.

The frame 12 has a carriage 20 rotatably mounted thereon for rotation about a generally vertical axis or rotation 22. The carriage 20 supports an operator's station 23 with controls, generally indicated with the reference numeral 24, to affect operation of the machine 10. The carriage 20 is provided with a ring gear 25 rotatably supported by the frame 12 and engageable with a motor 27, preferably hydraulically driven, to affect rotation of the ring gear 25 and attached carriage 20. The axis of rotation 22 corresponds to the center of said ring gear 25 forming the means of rotation of the carriage 20. It will be appreciated by one skilled in the art that a carriage 20 mounted in the manner described above is capable of rotation through an entire 360° arc; however, from a practical consideration, an arc of 270° centered about a fore-and-aft extending orientation would be sufficient for most operational purposes. An engine 28 can be mounted on the frame 12 rearwardly of the carriage 20 to provide operational power for the earthworking machine 10 and can be situated to permit effective movement of the carriage 20 about the vertical axis 22 with a rearward counterweight 29 being positioned to clear the engine 28 during its rotative movement.

A backhoe assembly 30 is mounted on the front face 21 of the carriage 20 and includes an articulated boom 32 hydraulically controlled in a conventional manner by hydraulic cylinders 33,34, and an earthworking tool shown in the form of a backhoe bucket 35 movably mounted on the end of the boom 32 and controlled in a conventional manner by means of a hydraulic cylinder 37. The backhoe assembly 30 is operable from the front face 21 of the carriage 20 throughout the entire range of rotation of the carriage 20 about the generally vertical axis 22 so as to be operable beyond the frame 12 to engage the ground G. Since the operator's station 23 rotates with the carriage 20, the operator will always have the digging operation of the backhoe assembly 30 occurring immediately in front of him with the controls 24 being easily accessible throughout the entire range of movement of the carriage 20, even when the backhoe assembly 30 is working laterally of the frame 12.

Figure 3:
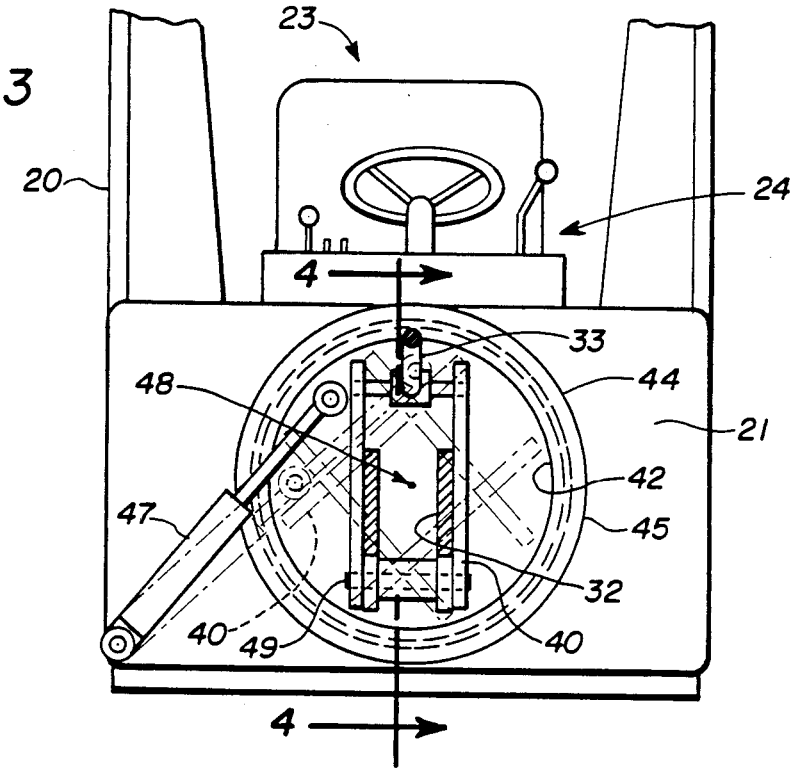
FIG. 3 is a partial cross-sectional view of the earthworking machine taken along lines 3—3 of FIG. 1 to show the thrust ring connecting the backhoe assembly to the front face of the carriage, the rotational movement of the mounting frame of the backhoe assembly being shown in phantom.
Figure 4:
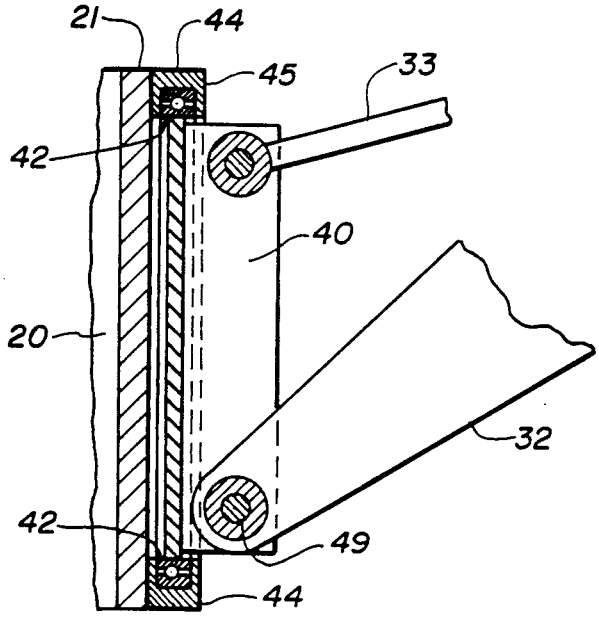
FIG. 4 is a partial cross-sectional view taken along lines 4—4 of FIG. 3 to show greater detail of the mounting of the backhoe assembly to the front face of the carriage.

Referring now to FIGS. 1, 3 and 4, the structure for mounting the backhoe assembly 30 to the front face 21 of the carriage 20 can best be seen. The backhoe assembly 30 includes a mounting frame 40 to which the articulated boom 32 and the hydraulic cylinder 33 are pivotally connected, the vertical movement of the boom 32 being controlled by the selectively variable length of the hydraulic cylinder 33 in a conventional manner. The mounting frame 40 is affixed to the inner race 42 of a thrust ring 45, the outer race 44 of the thrust ring 45 being affixed to the front face 21 of the carriage 20. The rotative movement of the mounting frame 40 and consequently the inner race 42 of the thrust ring 45 is controlled by a hydraulic cylinder 47 interconnecting the front face 21 of the carriage 20 and the mounting frame 40. As best seen in FIG. 3, the extension and contraction of the hydraulic cylinder 47 can affect a rotation of the mounting frame 40 through an arc of approximately 90° centered about a configuration in which the hydraulic cylinder 33 is positioned vertically above the pivot axis 49 of the articulated boom 32 carried by the mounting frame 40, which corresponds to the vertical orientation of the boom 32. This particular configuration described above permits the entire backhoe assembly 30 to be canted or tilted about a horizontal axis 48 extending outwardly from the front face 21 of the carriage 20, the horizontal axis 48 corresponding to the center of the thrust ring 45, thereby permitting the entire backhoe assembly 30 to be moved in the "Z plane". The normally horizontal pivot axis 49 of the boom 32 rotates with the mounting frame 40 about the horizontal axis of rotation 48, permitting the articulated boom 32 a full range of movement toward and away from the carriage 20 during its entire range of movement about the horizontal axis of rotation 48.

As can be seen in FIGS. 1, 2 and 5–7, the earthworking machine 10 is also provided with a scraper assembly 50 pivotally attached to the rear subframe 13 to permit a vertical movement thereof which can be affected by hydraulic cylinders 52. The scraper assembly 50 is provided with a forwardly extending support arm 54 upon which is mounted a scraper blade 55. The support arm 54 is articulated and is selectively movable about a first horizontally extending pivot 51 carried by the rear subframe 13 to permit the vertical movement of the scraper assembly 50 by the hydraulic cylinders 52, about a first generally vertical pivot 56 to permit a side-to-side swinging of the support arm 54 and attached blade 55 controlled by the hydraulic cylinder 57 interconnecting the rear subframe 13 and the support arm 54, about a second generally vertical pivot 58 to permit an angular movement of the scraper blade 55 relative to the support arm 54 as affected by the hydraulic cylinder 59 interconnecting the support arm 54 and a hat-shaped section 62 mounting the scraper blade 55 to the support arm 54.

The hat-shaped section 62 is pivotally connected to the support arm 54 by the pivot 58 and is engaged by the scraper blade 55 by means of a corresponding C-shaped channel into which the hat-shaped section 62 is slidably received. A hydraulic cylinder 66 interconnecting the hat-shaped section 62 and the C-shaped channel 64 selectively permits the blade 85 to be transversely shifted with respect to the support arm 54. Accordingly, it can be seen that the scraper assembly 50 can be positioned in virtually any configuration between the front and rear wheels 17,14 to affect the desired grading operation, with the support arm 54 being configured to push the scraper blade 55 across the ground G rather than pulling the blade across the ground as is typical with prior art graders.

Referring again to FIGS. 1, 2, and 5–7, the scraper assembly 50 is also provided with a pair of transversely spaced stabilizer pads 70 mounted adjacent opposing ends of the scraper blade 55. Each stabilizer pad 70 includes a ground engaging member 72 which is selectively positionable beneath the scraper blade 55 to serve as stabilizing outriggers when the earthworking machine 10 is being utilized as a backhoe or loader as will be described in greater detail below. Each stabilizer pad 70 is shown as having a support shaft 74 extending upwardly from the ground engaging member 72 and being received through a sleeve 76 supported by the hat-shaped member 62. A pin 77 extending through the sleeve 76 and through a corresponding hole in the support shaft 74 locks the stabilizer pad 70 into its preselected position. To facilitate proper engagement between the ground engaging member 72 and the scraper blade 55, due to the capability of the blade 55 to be moved transversely with respect to the hat-shaped member 62, each sleeve 76 is positionably connected to the hat-shaped member 62 to permit a selective corresponding movement of the sleeve 76 in a transverse direction relative thereto.

When the machine 10 is being utilized as a grader and, consequently the stabilizer pads 70 need to be moved into a nonground engaging position, the support shaft 74 can be reinserted through the top of the sleeve and pinned into position by the pin 77 such that the ground engaging member 72 rests on top of the scraper blade 55 as shown in phantom in FIGS. 6 and 7. Alternatively, the stabilizer pad 70 could be swivelly mounted to the hat-shaped section 62 to permit the ground engaging member 72 to be pivoted into respective ground engaging and nonground engaging positions relative to the scraper blade 55. The use of the blade 55 to rest upon the ground engaging member 72 when used as a stabilizing outrigger permits the hydraulic cylinders 52 to exert downward pressure thereon to fully affect a stabilizing of the machine 10 when it is being utilized as a backhoe.

Figure 9:
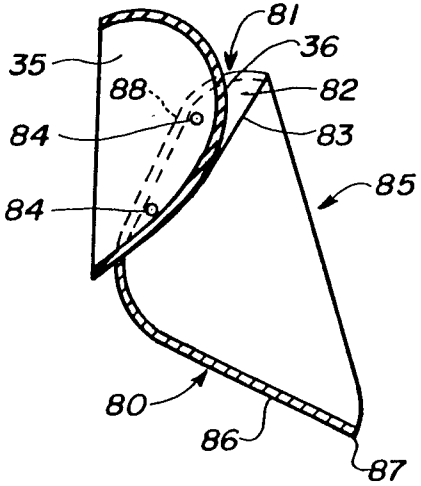
FIG. 9 is a partial cross-sectional detail view taken along lines 9—9 of FIG. 8 to show the mounting of the loader bucket to the backhoe bucket.
Figure 8:
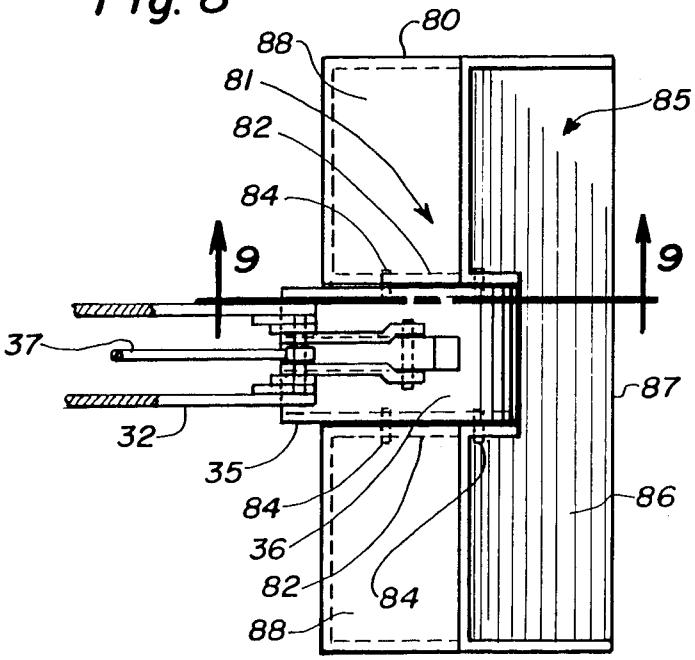
FIG. 8 is a partial cross-sectional view taken along lines 8—8 of FIG. 1 to show the mounting of the loader bucket to the backhoe bucket forming a part of the backhoe assembly.

Referring now to FIGS. 1, 8 and 9, it can be seen that the backhoe bucket can be equipped with a loader bucket 80 having a floor portion 86 equipped with a material engaging edge 87 to permit the machine 10 to be utilized as a loader, as well as a backhoe and grader. The back wall 88 of the loader bucket 80 is provided with a mounting apparatus 81 including fore-and-aft extending mounting flanges 82 transversely spaced a distance substantially equal to the width of the backhoe bucket 35. A transverse wall 83 extending between the fore-and-aft extending sidewalls 82 is of a configuration to conform to the shape of the back side 36 of the backhoe bucket 35. As a result, the loader bucket 80 can be positioned snugly against the back side 36 of the backhoe bucket 35 and fixed into position by a pair of connectors 84, which can be in the form of mounting pins, interengaging corresponding holes in the fore-and-aft extending mounting flanges 82 and the sides of the backhoe bucket 35. The mounting apparatus 81 could be literally recessed into the cavity 85 of the loader bucket 80, whereby the back side 36 of the backhoe bucket 35 could form the transverse wall 83 without the need to have a separate transverse wall 83, or, alternatively, could project rearwardly from the back wall of the loader bucket 80 so that the capacity of the bucket cavity 85 would not be diminished. The hydraulic cylinder 37 controlling the motion of the backhoe bucket 35 relative to the articulated boom 32 will also control the attitude of the loader bucket 80 since it is connected directed to the backhoe bucket 35.

It will be understood by one skilled in the art that an earthworking machine 10 configured as described above will be operable to function as a backhoe, loader, grader and also as a dozer when utilized with a dozer blade equipped similarly to the loader bucket 80 described above. The telescopible front wheel assembly 15 can be positioned rearwardly toward the rear wheels 14 when the machine 10 is utilized as a backhoe or loader so as to give the earthworking tools 35,80 sufficient room to operate both forwardly and laterally of the machine 10 by virtue of the rotatable carriage 20 upon which the backhoe assembly 30 is rotatably mounted. When the machine 10 is utilized as a grader, the front wheel assembly 15 can be extended forwardly away from the rear wheels 14 through actuation of the hydraulic cylinder 18 to permit a greater control of the scraper assembly 50 as is desirable with such machines. The canting of the backhoe assembly 30 about the horizontal axis 48 permits the backhoe 80 to be utilized in situations heretofore unrealized without limiting the range of motion of the earthworking tool 35,80.

It will be understood that various changes in the details, materials, steps and arrangements of parts which have been described and illustrated to explain the nature of the invention, will occur to and may be made by those skilled in the art upon a reading of the disclosure within the principles and scope of the invention. The foregoing description illustrates preferred embodiments of the invention. However, concepts, as based upon such a description, may be employed in other embodiments without departing from the scope of the invention. Accordingly, the following claims are intended to protect the invention broadly, as well as in the specific form shown herein.

Having thus described the invention, what is claimed is:

1. An earthworking machine comprising:

a mobile frame having a rear frame member supported by a pair of rear ground engaging wheels and telescopically receiving a front frame member supported by a pair of front ground engaging wheels, said front frame member being movable in a fore-and-aft direction relative to said rear frame member to permit a selective varying of the distance between said front wheels and said rear wheels;

scraper means supported beneath said frame between said front and rear wheels for scrapingly engaging the ground to effect a grading thereof, said scraper means having a blade assembly operably positionable for selective engagement of the ground in variable attitudes relative to said frame;

a carriage rotatably supported on said frame for rotative movement in a generally horizontal plane, said carriage having an extensible earth working tool mounted thereon for selective engagement of the ground forwardly of said front frame member; and power means supported by said frame for operatively powering the movement of said machine, said scraper means and said earth working tool.

2. The earthworking machine of claim 1 wherein said carriage is mounted to a ring gear rotatably supported by said rear frame member, said carriage including a rotation drive means operatively powered from said power means and engageable with said ring gear to control the rotated position of said carriage relative to said rear frame member.

3. The earthworking machine of claim 2 wherein said carriage is rotatable through a generally horizontal arc of at least approximately 270 degrees.

4. The earthworking machine of claim 2 wherein said earthworking tool includes a backhoe boom and attached backhoe bucket engageable with the ground on at least three sides of said mobile frame.

5. The earthworking machine of claim 4 wherein said scraper means includes a fore-and-aft extending support arm pivotally connected at a rearward end to said rear frame member and having said blade assembly connected to a forward end thereof, said support arm being movable in a generally vertical direction about said pivot by a first linear actuator interconnecting said support arm and said rear frame member.

6. The earthworking machine of claim 5 wherein said blade is pivotally connected to said support arm for rotation about a generally vertical axis, said scraper means including a second linear actuator interconnecting said blade assembly and said support arm to control the orientation of said blade assembly relative to said support arm.

7. The earthworking machine of claim 6 wherein said blade assembly includes a generally transversely extending support member pivotally connected to said support arm about said vertical pivot axis and a blade member slidably engaged with said support member for movement relative thereto in a generally transverse direction, a third linear actuator interconnecting said support member and said blade member controlling the relative orientation therebetween.

8. The earthworking machine of claim 7 wherein said support arm has a vertical pivot joint adjacent its rearward end to permit a generally horizontal swinging movement of said support arm, a fourth linear actuator interconnecting said rear frame member and said support arm controlling said horizontal swinging movement thereof.

9. The earthworking machine of claim 5 wherein said blade assembly carries a pair of selectively positionable, transversely spaced outriggers movable between an elevated position and a ground engaging position in which said earthworking machine is stabilized for a more efficient use of said earthworking tool.

10. The earthworking machine of claim 9 wherein each said outrigger includes a ground engaging member which when moved into said ground engaging position is engageable with a blade member forming a part of said blade assembly, each said ground engaging member being positionable between said blade member and the ground when in said ground engaging position.

11. The earthworking machine of claim 10 wherein each said outrigger is also positionally adjustable relative to said blade assembly in a transverse direction.

12. The earthworking machine of claim 3 wherein said carriage carries an operator's platform such that the operation of said earthworking tool is forwardly thereof during the entire range of rotation of said carriage relative to said mobile frame.

13. The earthworking machine of claim 12 wherein said front frame member and said rear frame member are interconnected by a fifth linear actuator to control the extensible movement of said front frame member relative to said rear frame member.

14. The earthworking machine of claim 13 wherein said front frame member has a forward limit of extensible movement relative to said rear frame member to establish a forwardmost position of said front frame member, said earthworking tool being operable forward of said front frame member when in said forwardmost position.

15. The earthworking machine of claim 14 wherein said front frame member includes at least one longitudinally extending slide member telescopically received within a corresponding guide member forming a part of said rear frame member.

16. The earthworking machine of claim 15 wherein said fifth linear actuator is positionable inside of said at least one slide member and the corresponding guide member.

* * * * *